US006294865B1

(12) United States Patent
Van Der Heijden

(10) Patent No.: US 6,294,865 B1
(45) Date of Patent: Sep. 25, 2001

(54) DISPLAY DEVICE HAVING A CATHODE RAY TUBE

(75) Inventor: Joseph W. J. M. Van Der Heijden, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/383,815

(22) Filed: Aug. 26, 1999

Related U.S. Application Data

(63) Continuation-in-part of application No. 08/934,998, filed on Sep. 22, 1997, now abandoned.

(51) Int. Cl.[7] ..... H01J 29/51; H01J 29/52

(52) U.S. Cl. ..... 313/411; 313/414; 313/415; 313/409

(58) Field of Search ..... 313/411, 414, 313/415, 409

(56) References Cited

U.S. PATENT DOCUMENTS 3,771,002 * 11/1973 Standaart ..... 313/69 C
4,528,476 * 7/1985 Alig ..... 313/412
5,909,080 * 6/1999 Uchida et al. ..... 313/414

* cited by examiner

*Primary Examiner*—Bruce Anderson
*Assistant Examiner*—Nikita Wells

(57) ABSTRACT

Display device having an in-line electron gun with a main lens, in which the anode voltage ranges between 16 and 22 kVolt and the parameter $V_a^{0.5}.p^{3/2}$ is greater than 50 $kVolt^{0.5}$ $mm^{3/2}$. A reduction of the total power can be achieved without sacrificing front-end performance.

9 Claims, 3 Drawing Sheets

DISPLAY DEVICE HAVING A CATHODE RAY TUBE

RELATED APPLICATIONS

This application is a continuation-in-part of application Ser. No. 08/934,998, filed Sep. 22, 1997 now abandoned.

BACKGROUND OF THE INVENTION

The invention relates to a display device having a cathode ray tube comprising an in-line electron gun for generating three in-line electron beams in a neck of the cathode ray tube, the in-line electron gun comprising a main lens part having three apertures for passing the three electron beams, and a deflection unit, the display device having means to supply an anode voltage to an electrode of the main lens and having a cathodoluminescent phosphor screen provided on a viewing panel of the cathode ray tube.

Display devices of the type mentioned in the first paragraph are used, for instance, in computer monitors and television apparatuses.

Display devices of the type mentioned in the first paragraph are known and on the market.

In operation, such display devices consume power. The operating power adds to the total cost of an apparatus, but apart from the cost factor, the power consumption of in particular computer monitors is an issue of environmental concern. This has led, e.g., to the EPA "Energy Star" guidelines, which most likely will be gradually included in legislation as well. From June 1998 a new IEC standard 1000-3-2 will become effective which sets standard limits for harmonic currents injected into the public supply system for all applications having an active input power exceeding 75 Watt. Depending on the size, computer monitors have averagely an active input power of around 80–85 Watt. Therefore, it is important, from the point of view of environmental concern, to reduce the power consumption of such display devices.

SUMMARY OF THE INVENTION

It is an object of the invention to provide a display device with a low power consumption, yet without substantially reducing the image quality, in particular the colour purity.

To this end, a display device in accordance with the invention is characterized in that, in operation, the anode voltage supplied to the electron gun lies in the range 16–22 kVolt and the product of the square root of the anode voltage ($V_a^{0.5}$) and the electron beam pitch p in the main lens raised to the 3/2 power ($p^{3/2}$), i.e. $V_a^{0.5}.p^{3/2}$, is greater than 50 $kVolt^{0.5}$ $mm^{3/2}$.

The electron beam pitch is half the distance between the centres of the outer electron beams in the main lens of the gun. Conventional cathode ray tubes have an anode voltage of 25–30 kVolt. The power consumed by a display device having a cathode ray tube is reduced substantially by reducing the anode voltage. The energy dissipated in the deflection unit and the drive circuit for the deflection unit is roughly proportional to the anode voltage. Reducing the anode voltage reduces the energy consumption of the deflection unit, roughly in accordance with the anode voltage. Image quality is decreased, however, appreciably if the value of $V_a^{0.5}.p^{3/2}$ is smaller than 50 $kVolt^{0.5}$ $mm^{3/2}$. The influence of magnetic spot displacement due to the earth's magnetic field is roughly inversely proportional to $V_a^{0.5}.p^{3/2}$ and at values below 50 $kVolt^{0.5}$ $mm^{3/2}$ the influence becomes appreciable, leading, in particular, to a reduction of the colour purity. The earth's magnetic field influences the paths of the electron beams such that the beams at least partly impinge on phosphors of the "wrong colour" thereby negatively influencing the colour rendition. This effect results in a loss of colour purity. Reduction of the anode voltage reduces the value for $V_a^{0.5}.p^{3/2}$ and thus colour purity can be negatively influenced. In devices according to the invention this effect is, however, limited. In devices having a cathode ray tube having a black-matrix on the screen the influence could be reduced by increasing the dimensions of the black matrix. This, however, leads to a reduction of the luminance. The negative effects on colour purity are usually at an acceptable level for values higher than 50 $kVolt^{0.5}$ $mm^{3/2}$. Preferably the value for $V_a^{0.5}.p^{3/2}$ is somewhat larger, i.e. larger than 55 $kVolt^{0.5}$ $mm^{3/2}$, because magnetic fields other than the earth's magnetic field may be present in and around the device. Preferably, the value of $V_a^{0.5}.p^{3/2}$ is less than 80 $kVolt^{0.5}$ $mm^{3/2}$. A further increase of the value has only a limited positive effect, but may result in an increase in the operating power. In embodiments of the present invention the cathode ray tube is provided with a black-matrix layer between the viewing panel and the phosphor screen, which black matrix has apertures for passing light generated by the phosphor screen, the apertures having a maximum dimension (e.g. width or length) below 125 micrometers in at least one direction. For such small apertures in the black matrix the limitation to the value of $V_a^{0.5}.p^{3/2}$ is of particular importance. In embodiments of the invention the display device has means for applying oscillating currents having a frequency higher than 65 kHz to the deflection unit, the deflection unit having deflection coils comprising solid wires. At such high frequencies, Litz wire, i.e. a type of wire in which several small strands are used in one wire, was used. By virtue of the reduction of power dissipation in the deflection unit, the present invention has the advantage that solid wire, i.e. wire in which only a single conductive core is used, can be used at frequencies above 65 kHz, even above 70 kHz. Important costs savings are the result. In other embodiments, in which the aim is to further reduce power consumption, the deflection unit comprises coils wound from Litz wire.

DESCRIPTION OF THE PREFERRED EMBODIMENTS

Figure 1:
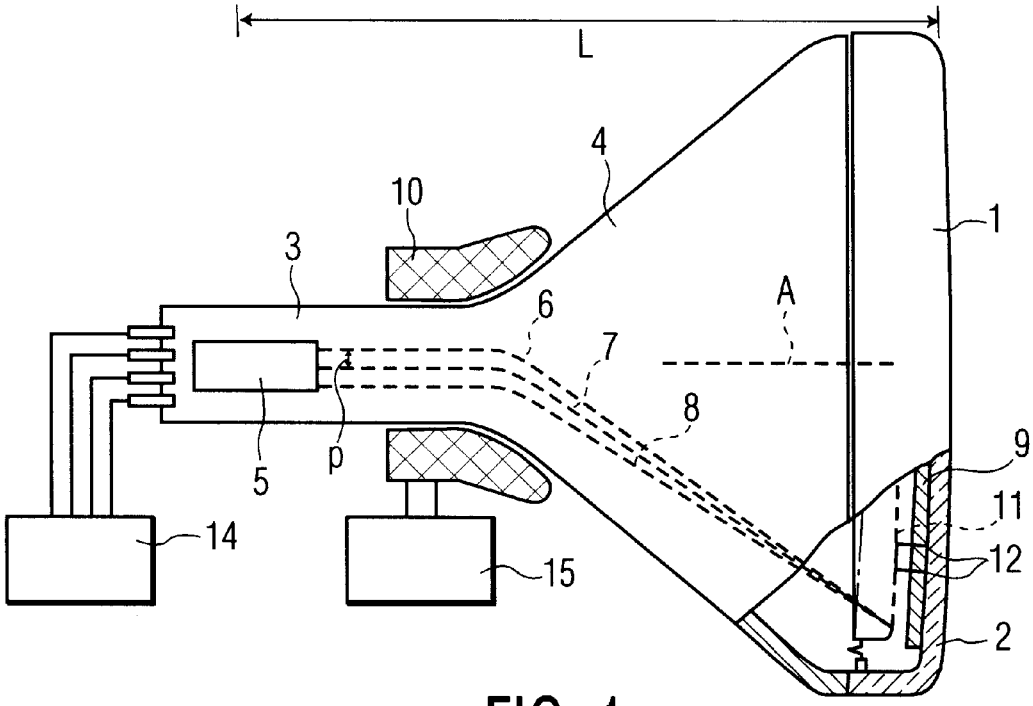
FIG. 1 shows a display device having a cathode ray tube and a deflection unit.

The figures are not drawn to scale,

FIG. 1 is a partly perspective view of a cathode ray tube 1. Said cathode ray tube 1 comprises an evacuated envelope 3 having a display window (also called viewing panel) 2, and a neck 4. In the neck there is provided an electron gun 5 for generating, in this example, three electron beams 6, 7 and 8. On the inside of the display window 2 there is provided a luminescent display screen 9 which, in this example, comprises phosphor elements luminescing in red, green and blue. On their way to the screen 9, said electron beams 6, 7 and 8 are deflected across the screen 9 by means of a deflection unit 10, which is located at the junction between the neck and the cone, and pass through the colour selection electrode, in this example the shadow mask 11 which comprises a thin plate having apertures 12. The electron beams 6, 7 and 8 pass through said apertures 12 at a small angle with respect to each other and each electron beam impinges on phosphor elements of only one colour. The screen and the shadow mask are at the same high voltage as the last electrode (anode) of the gun. In the main lens, the electron beams are separated by a distance p, the electron beam pitch. The distance p is the distance between the centres of adjacent electron beams in the main lens. For clarity, the distance p is shown as the electrons leave the electron gun not in the main lens itself. In some embodiments between the phosphor screen 9 and the display window 3 a black matrix is present. A black matrix is a black layer with apertures for passing light emitted by the phosphor screen. The display device comprises means 14 to supply voltages to the electron gun and means 15 to supply deflection currents to the deflection unit 10.

Figure 2:
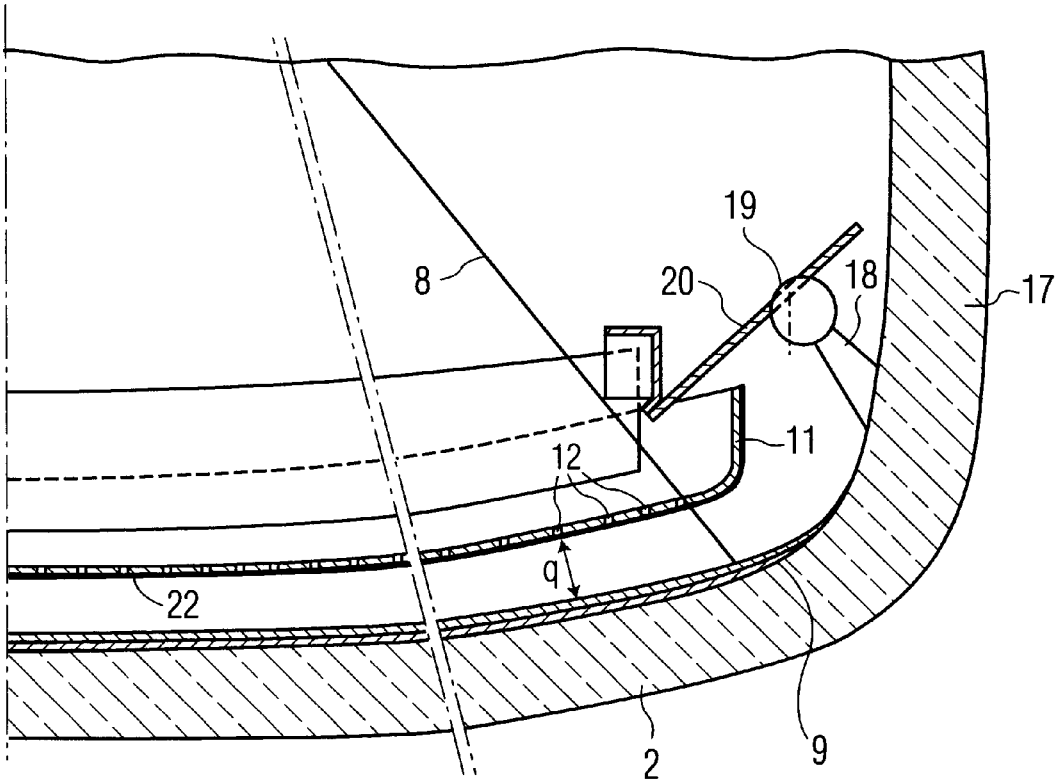
FIG. 2 shows a detail of the display device of FIG. 1.

FIG. 2 shows is a sectional view of a colour display tube, showing in more detail a shadow mask 11, which is suspended in front of the screen 9. In this example, the display window has a raised edge 17 in the corners of which supporting means, for example in the form of pins 18 having a free end portion 19, are provided. The free end portion 19 of the pin 18 partly projects from an aperture in a resilient element 20 of the suspension means. The shadow mask 11 is attached to a frame 24 to increase the sturdiness of the shadow mask. Electron beam 8 passes through apertures 12 in the shadow mask and is incident on a phosphor element of screen 9. Within the framework of the invention, the way in which the shadow mask is suspended is not essential and FIG. 2 merely shows an example. The electron beam 8, upon impinging on the phosphor screen releases part all of its kinetic energy and excites the phosphor, which emits light through the display window 2. FIG. 1 shows also the distance between the electron beams p, also called the electron beam pitch and FIG. 2 shows the distance q between the shadow mask 11 and the screen 9.

Figure 3:
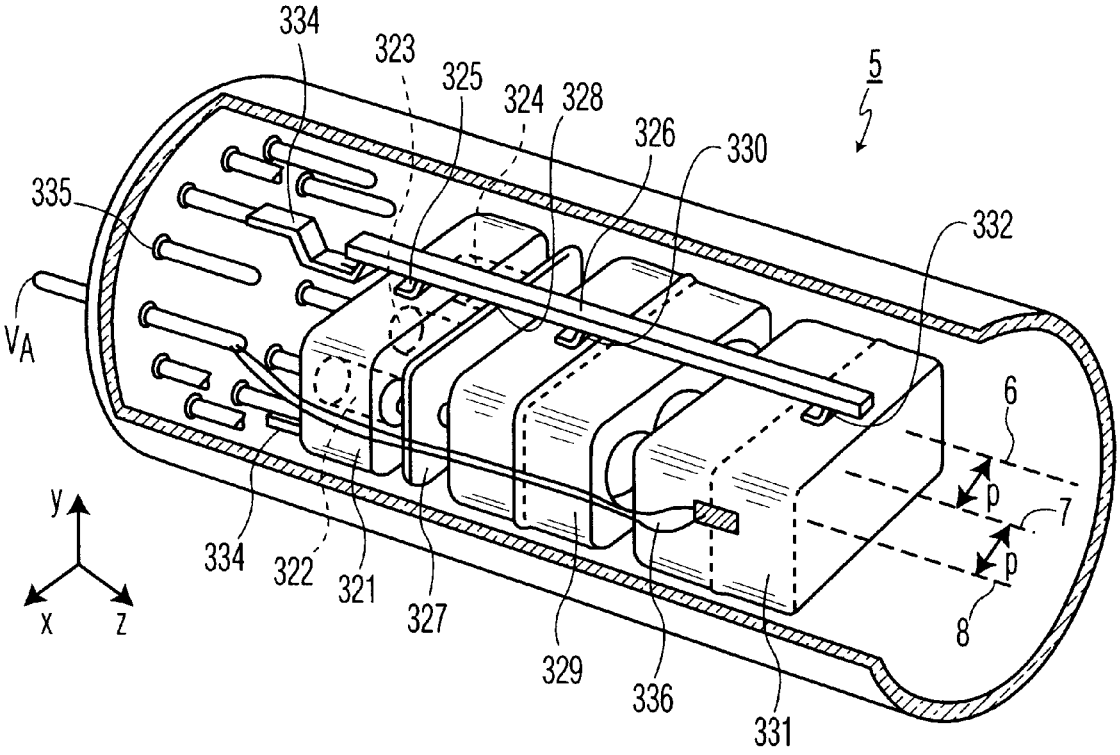
FIG. 3 is a diagrammatic, partly perspective view of an electron gun 5.

FIG. 3 is a diagrammatic, partly perspective view of an electron gun 5. Electron gun 5 comprises a common control electrode 321, also referred to as $G_1$ electrode, in which three cathodes 322, 323 and 324 are secured. The $G_1$ electrode is secured to supports 326 by means of connecting elements 325. Said supports are made of glass. Examples of such supports are the supports which are commonly referred to as "beading rods". In this example, the electron gun 5 further comprises a common plate-shaped electrode 327, also referred to as $G_2$ electrode, which is secured to the supports by connecting elements 328. In this example, the electron gun 5 comprises two supports 326. One of said supports is shown, the other is situated on the side of the electron gun 3 which is invisible in this perspective view. The electron gun 3 further comprises the common electrodes 329 and 331 which are also secured to supports 326 by means of connecting elements (330 and 332, respectively). Between electrodes 329, supplied with apertures 338, 339 and 340, and 331 the main lens is formed. In operation the anode voltage is supplied to electrode 332. In this example, the supports are secured on feed-through pins 335 by means of brackets 334. The electrical connections between the feed-through pins and the electrodes are not shown. One of the pins 335 is supplied with the anode voltage $V_a$. Lead 336 interconnects this pin and the electrode 331.

Figure 4:
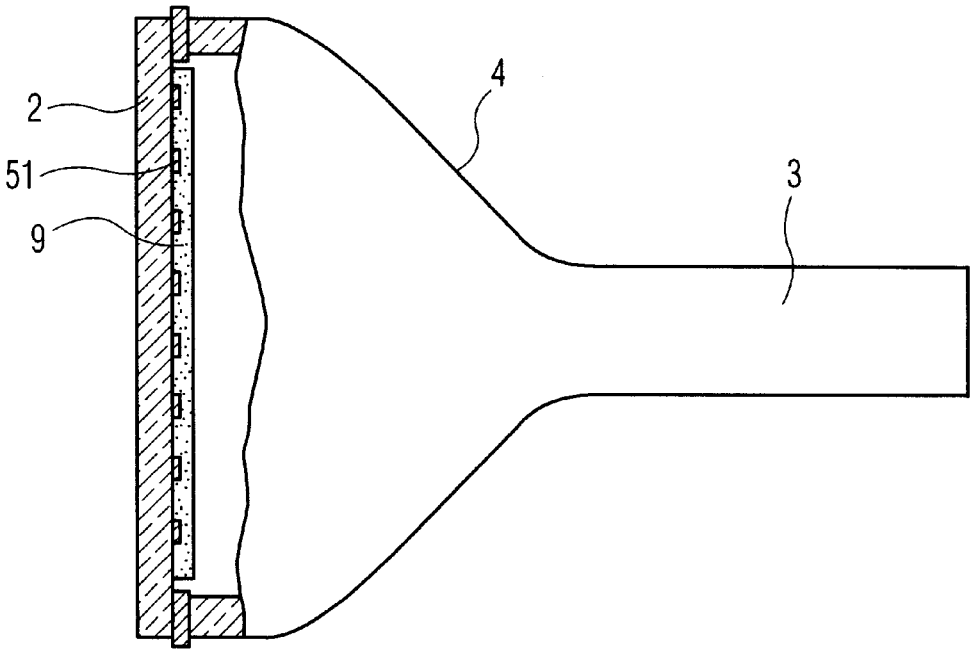
FIG. 4 is a sectional view of an envelope of a color cathode ray tube providing a black-matrix layer.

FIG. 4 is a cross-sectional view of an evacuated envelope 3 of the cathode ray tube 5 having a black matrix 51 provided between the phosphor screen 9 and the display window 2.

The approximate power consumption of a conventional display device is approximately given in table 1 below.

| part of the device | percentage |
|---|---|
| horizontal deflection | 39% |
| vertical deflection | 7% |
| power supply | 19% |
| screen | 14% |
| heater | 5% |
| other | 16% |

The energy for horizontal deflection includes the energy for the generation of voltage in the horizontal deflection circuit and energy dissipated in the horizontal (line) deflection coils. The energy for vertical direction includes the energy dissipated in the frame (vertical) deflection coils and in the vertical deflection circuit. The total of the horizontal and vertical deflection power is hereinafter also referred to as "deflection power". The screen power includes the product of the anode voltage and the total beam current.

The power supply includes the power dissipation in the power supply circuitry. The category "other" includes other power dissipating circuits (e.g. video circuitry).

The power consumption can be reduced, for example, by reducing the diameter of the neck of the envelope. This allows the deflection unit to be positioned closer to the electron beams, which decreases the volume in which the electron beams are deflected, which should lead to a reduction of the energy necessary for deflecting the electron beams. The inventor has found, however, that such reduction is at least partly counteracted by an increase in ohmic losses of the deflection unit. Comparing several designs a 30% reduction in the neck dimensions was found to lead an approximately 12% reduction in the power needed for deflecting the electron beams. A 20% reduction was found to lead to a reduction of approximately 5%.

A reduction of the anode voltage to values indicated above (16–22 kVolt) leads to greater savings in deflection power savings (in the order of 20–35%). Since the deflection power amounts to 45–50% of the total power required, the power savings are in the order of 15% of the total power, which is far more than can be obtained by decreasing the diameter of the neck. For example, by use of the display device of the invention, a total power of 80–85 Watts is reduced to below 75 Watt, namely 68–72 Watt.

An important aspect of a display device having a cathode ray tube is the image quality. Particularly, colour purity is of importance. The colour purity is dependent on the parameter $V_a^{0.5}.p^{3/2}$ as will be explained below:

dependence on p

The distance q between the mask and the phosphor screen is inversely proportional to the electron beam pitch p according to the formula:

$$q=a_h*L/(3*p)$$

where L is the gun to screen distance, ah is the horizontal screen pitch (the distance between neighbouring phosphor areas of the same colour in the horizontal direction) and p is the electron beam pitch, i.e. the distance between the centres of neighbouring electron beams in the main lens.

Between the shadow mask 11 and the screen 9, the electron beams are influenced by magnetic fields such as the earth's magnetic field. The displacements of the electron beams due to this influence are proportional to $q^1$ and $q^2$, on average to $p^{3/2}$.

Since q is inversely dependent on the electron beam pitch p, where the other parameter L and $a_h$ are for a given type of display more or less constant, the displacement is proportional to $p^{-3/2}$.

Dependence on the anode voltage $V_a$.

The spot displacements are inversely proportional to the square root of the anode voltage ($V_a^{0.5}$).

The total displacement of the electron beams is therefore inversely proportional to the parameter $V_a^{0.5}.p^{3/2}$. A decrease of this parameter leads to an increase of the displacements. Therefore, within the framework of the invention this parameter is limited to values higher than 50 $kVolt^{0.5}$ $mm^{3/2}$. In particular when a black matrix, having apertures below 125 micrometers, is present between the phosphor screen 9 and the viewing panel 2, it is important to limit the spot displacement. A spot displacement due to the earth's magnetic field is of the order of 10–15 micrometer. Reducing the parameter $V_a^{0.5}.p^{3/2}$ increases the magnetic spot displacements. If a constant amount of colour purity is to be obtained, an increase of 5 micrometer in displacements will require a decrease of the apertures in the black matrix by 5 micrometer. The diameter of the aperture is then 120 micrometer. The luminance will be reduced by a factor which is approximately proportional to the surface area of the aperture, i.e. by a factor $120^2/125^2=0.91$. The luminance will be reduced by 9%, or alternatively the colour purity will be reduced. The luminance can be increased by increasing the beam current, this will however increase the required power. Furthermore the temperature of the shadow mask will increase. This increase will lead to an increase in doming effects which have a negative effect on the colour purity. When the size (diameter or smallest dimension) of the apperatures becomes less than 100 micrometer, the above cited negative effects of an increase of the spot displacements due to the influence of the earth's magnetic field become even stronger.

Apart from the above cited aspects a relatively high value for $V_a^{0.5}.p^{3/2}$ has the advantage that the electron beam spot performance in itself is improved or at least can be held at an acceptable level. Main lenses in an in-line electron gun show appreciable spherical aberrations. To reduce these aberrations only the middle part of the lens is used. A reduction of the electron beam pitch p causes the distance between the apertures for passing the electron beams to be reduced. As a result, the diameter of the lenses formed in the main lens is reduced, increasing the spherical aberrations. To counteract these effects, dynamic voltages could be applied to the electron gun (so-called DAF-solutions). The dynamic signals needed for such a gun require additional power and the circuitry needed is expensive.

The value for $V_a$ ranges preferably between 18 and 21 kVolts. The lower the anode voltage is, the more the power consumption can be reduced. However, for anode voltages lower than 18 kVolt the strength of the main lens is relatively small. An in-line electron gun has a pre-focusing lens in front of the main lens. As the strength of the main lens is reduced, the distance between the main lens and the pre-focusing lens should be increased. This leads to an increase of the overall dimension of the cathode ray tube.

Figure 5:
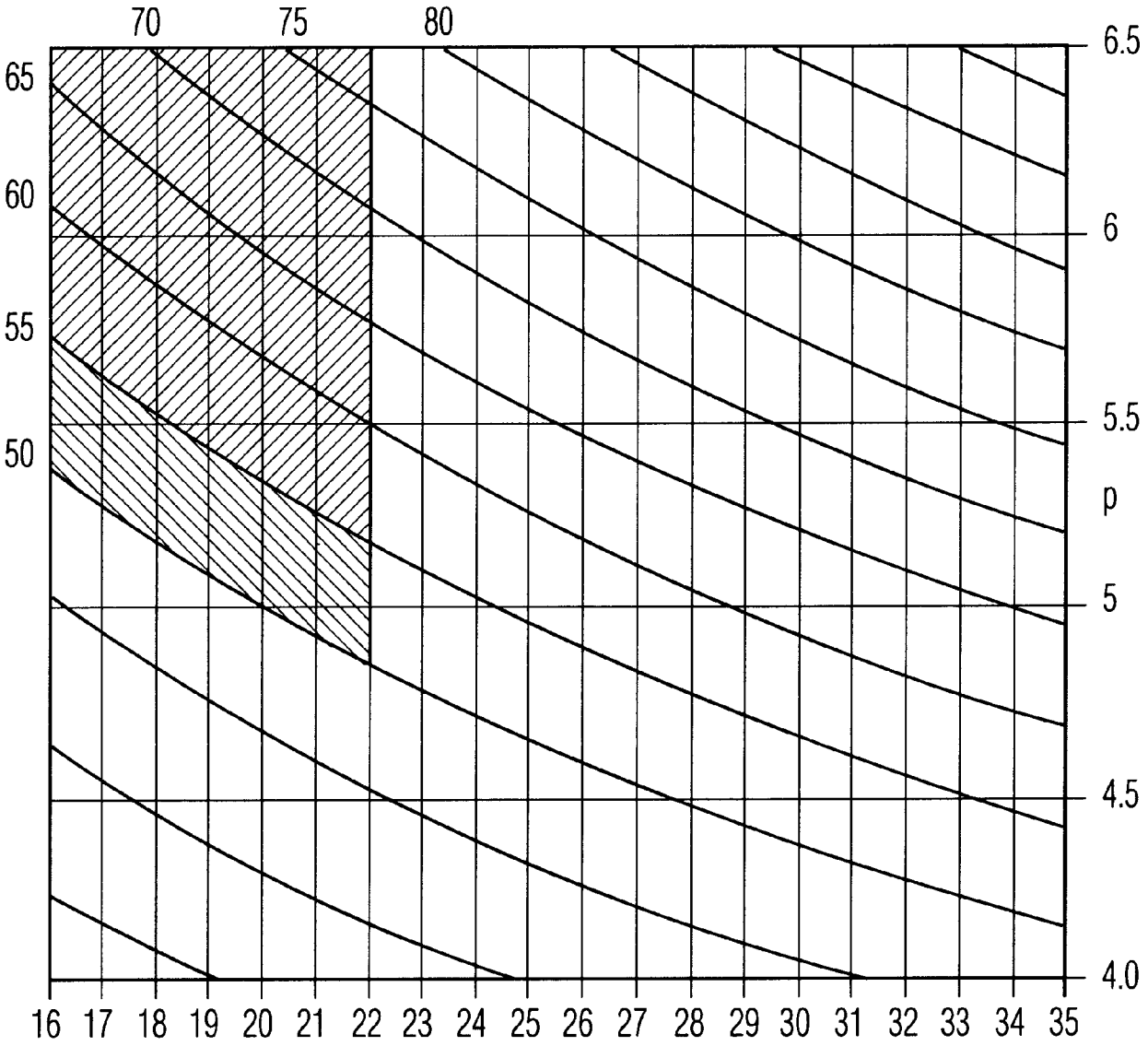
FIG. 5 graphically shows the $V_a$ and p-values for the present invention.

FIG. 5 graphically shows the relation between the anode voltage $V_a$ in kVolt on the horizontal axis, the electron beam pitch p in mm on the vertical axis and the value for $V_a^{0.5}.p^{3/2}$ (curved lines). At the left-hand side and across the top, next to the figure are the values for $V_a^{0.5}.p^{3/2}$.

In summary the present invention provides a display device having a cathode ray tube with an in-line electron gun with a main lens wherein the anode voltage is between 16 and 22 kVolt and the parameter $V_a^{0.5}.p^{3/2}$ is greater than 50 $kVolt^{0.5}$ $mm^{3/2}$. A reduction of the total power can be achieved without sacrificing colour purity.

It will be clear that within the scope of the invention many variations are possible.

What is claimed is:

1. Display device having a cathode ray tube comprising an in-line electron gun for generating three in-line electron beams in a neck of the cathode ray tube, the in-line electron gun comprising a main lens part having three apertures for passing the three electron beams, and a deflection unit, the display device having means to supply an anode voltage to an electrode of the main lens and having a cathodoluminescent phosphor screen provided on a viewing panel of the cathode ray tube, characterized in that in operation the anode voltage lies in the range 16–22 kVolt and the product of the square root of the anode voltage ($V_a^{0.5}$) and an electron beam pitch p in the main lens raised to the 3/2 power ($p^{3/2}$), is greater than 50 $kVolt^{0.5}$ $mm^{3/2}$.

2. Display device as claimed in claim 1, characterized in that $V_a^{0.5}.p^{3/2}$ is smaller than 80 $kVolt^{0.5}$ $mm^{3/2}$.

3. Display device as claimed in claim 1, characterized in that the anode voltage ranges between 18 and 21 kVolt.

4. Display device as claimed in claim 1, characterized in that the cathode ray tube is provided with a black-matrix layer between the viewing panel and the phosphor screen, which black matrix has apertures for passing light generated by the phosphor screen, the apertures having a maximum dimension (e.g. width or length) below 125 micrometers in at least one direction.

5. Display device as claimed in claim 1, characterized in that the display device has means for applying oscillating currents having a frequency above 65 kHz to the deflection unit, the deflection unit having deflection coils comprising solid wires.

6. Display device as claimed in claim 1, characterized in that the deflection unit comprises deflection coils wound from Litz wire.

7. Display device having a cathode ray tube comprising an in-line electron gun for generating three in-line electron beams in a neck of the cathode ray tube, the in-line electron gun comprising a main lens part having three apertures for passing the three electron beams, and a deflection unit, the display device having means to supply an anode voltage to an electrode of the main lens and having a cathodoluminescent phosphor screen provided on a viewing panel of the cathode ray tube, characterized in that in operation the anode voltage lies in the range 16–22 kVolt and the product of the square root of the anode voltage ($V_a^{0.5}$) and an electron beam pitch p in the main lens raised to the 3/2 power ($p^{3/2}$), is greater than 55 $kVolt^{0.5}$ $mm^{3/2}$.

8. Display device as claimed in claim 7, characterized in that $V_a^{0.5}.p^{3/2}$ is smaller than 80 $kVolt^{0.5}$ $mm^{3/2}$.

9. Display device as claimed in claim 7, characterized in that the deflection unit comprises deflection coils wound from Litz wire.

* * * * *